US007650882B2

(12) United States Patent
Little et al.

(10) Patent No.: US 7,650,882 B2
(45) Date of Patent: Jan. 26, 2010

(54) POT SUPPORTS AND BURNER SYSTEMS INCLUDING SAME

(75) Inventors: Derrick Douglas Little, Louisville, KY (US); Kevin Laundroche, Louisville, KY (US); Meghin Elizabeth Davis, Louisville, KY (US)

(73) Assignee: General Electric Company, Schenectady, NY (US)

( * ) Notice: Subject to any disclaimer, the term of this patent is extended or adjusted under 35 U.S.C. 154(b) by 111 days.

(21) Appl. No.: 11/112,577

(22) Filed: Apr. 22, 2005

(65) Prior Publication Data

US 2006/0236997 A1 Oct. 26, 2006

(51) Int. Cl.
*F23D 14/08* (2006.01)
*F24C 15/10* (2006.01)

(52) U.S. Cl. ..... 126/215; 126/211; 126/214 C; 126/214 R; 126/50

(58) Field of Classification Search ..... 126/39 R, 126/39 H, 40, 50, 211, 214 R, 214 A, 214 B, 126/214 C, 214 D, 212, 220, 221, 215; 431/354; D7/407–409
See application file for complete search history.

(56) References Cited

U.S. PATENT DOCUMENTS

| | | | | | |
|---|---|---|---|---|---|
| 358,478 | A | * | 3/1887 | Pond | 431/354 |
| 709,493 | A | * | 9/1902 | Lawler | 126/40 |
| 840,412 | A | * | 1/1907 | Ackroyd | 126/214 R |
| 845,297 | A | * | 2/1907 | Foley | 126/253 |
| 849,634 | A | * | 4/1907 | Nichlaus | 126/214 R |
| 865,183 | A | * | 9/1907 | Harmon | 126/39 R |
| 908,358 | A | * | 12/1908 | Van Dyke | 126/39 H |
| 1,072,115 | A | * | 9/1913 | Kaufman | 126/39 R |
| 1,444,770 | A | * | 2/1923 | Baker | 126/214 D |
| 1,570,683 | A | * | 1/1926 | Kohn | 431/355 |
| 1,703,115 | A | * | 2/1929 | Lee | 126/39 R |
| D89,673 | S | * | 4/1933 | Antrim | D7/408 |
| D94,689 | S | * | 2/1935 | Hobson | D7/408 |
| 2,040,446 | A | * | 5/1936 | Schneider | 126/39 R |
| 2,074,531 | A | * | 3/1937 | Becvar | 239/545 |
| 2,088,652 | A | * | 8/1937 | Hobson | 126/214 R |
| 2,116,149 | A | * | 5/1938 | Hobson | 126/39 N |
| 2,148,777 | A | * | 2/1939 | Schneider et al. | 126/39 H |
| 2,232,482 | A | * | 2/1941 | Schulz | 126/39 H |
| D126,420 | S | * | 4/1941 | Parker | D7/408 |
| D126,422 | S | * | 4/1941 | Parker | D7/408 |
| D127,709 | S | * | 6/1941 | Bradbury et al. | D7/408 |
| D129,007 | S | * | 8/1941 | Whitehead | D7/408 |
| 2,257,395 | A | * | 9/1941 | Parker | 126/39 K |

(Continued)

FOREIGN PATENT DOCUMENTS

DE 195 05 470 A1 8/1996

(Continued)

*Primary Examiner*—Carl D Price
(74) *Attorney, Agent, or Firm*—George L. Rideout, Esq.; Armstrong Teasdale LLP

(57) ABSTRACT

A pot support for a ceramic glass cooktop having integrally formed grates. The pot support is formed of a material able to withstand gas cooking temperatures without substantial alteration of its shape or composition. The pot support is configured to rest in a stable position over a gas burner head to support a relatively small diameter utensil centered over the burner head and to cooperate with the integrally formed grate to support large or small diameter utensils that are supported over the burner off-center relative to the grate.

21 Claims, 7 Drawing Sheets

U.S. PATENT DOCUMENTS

| | | | | | |
|---|---|---|---|---|---|
| 2,257,396 | A | * | 9/1941 | Parker | 126/39 J |
| 2,257,397 | A | * | 9/1941 | Parker | 126/214 C |
| 2,257,398 | A | * | 9/1941 | Parker | 126/214 C |
| 2,298,307 | A | * | 10/1942 | Parker | 126/39 H |
| 2,307,063 | A | * | 1/1943 | Parker | 126/39 R |
| 2,320,754 | A | * | 6/1943 | Sherman | 126/39 K |
| 2,376,520 | A | * | 5/1945 | Sterick | 239/425.5 |
| 2,499,707 | A | * | 3/1950 | Warren | 126/214 R |
| 2,506,483 | A | * | 5/1950 | Bechtold | 126/39 H |
| 2,521,936 | A | * | 9/1950 | Mueller | 126/214 R |
| 2,678,643 | A | * | 5/1954 | Williams | 126/214 C |
| 2,759,471 | A | * | 8/1956 | Crone | 126/39 H |
| 3,162,237 | A | * | 12/1964 | Brown et al. | 126/39 R |
| 3,289,731 | A | * | 12/1966 | Gustav | 126/39 R |
| 3,375,819 | A | * | 4/1968 | Davis | 126/211 |
| 3,592,180 | A | * | 7/1971 | Kweller et al. | 126/39 H |
| 4,078,543 | A | | 3/1978 | Anandasakaran | |
| 4,154,218 | A | * | 5/1979 | Hulet | 126/215 |
| D263,108 | S | | 2/1982 | Juracsik | |
| D265,882 | S | | 8/1982 | Shih | |
| 4,541,407 | A | * | 9/1985 | Sommers et al. | 126/39 E |
| 4,832,295 | A | | 5/1989 | Wagner | |
| D342,865 | S | | 1/1994 | Addison et al. | |
| 5,931,152 | A | * | 8/1999 | Fafet et al. | 126/214 R |
| D413,765 | S | | 9/1999 | Adler et al. | |
| 6,508,245 | B2 | | 1/2003 | Taplan | |
| 2003/0041740 | A1 | | 3/2003 | Varnhorn et al. | |

FOREIGN PATENT DOCUMENTS

| | | | |
|---|---|---|---|
| DE | 297 22 313 | * | 5/1998 |
| EP | 1 249 665 | * | 10/2002 |
| EP | 1249665 | * | 10/2002 |
| FR | 2723431 | * | 2/1996 |
| GB | 2223302 | * | 4/1990 |
| JP | 11-237057 | * | 8/1999 |
| JP | 11-351574 | * | 12/1999 |
| JP | 2001-343106 | * | 12/2001 |

* cited by examiner

POT SUPPORTS AND BURNER SYSTEMS INCLUDING SAME

BACKGROUND OF THE INVENTION

This invention relates generally to gas cooking apparatus, and more particularly to apparatus for supporting pots on a burner and to burner systems incorporating such apparatus.

Cooktop grates have been designed to support small and large pots that span the entire area above a burner. However, with the advent of ceramic glass cooktops in which the burner grates for supporting utensils over the burners are formed as an integral part of the cooktop, design constraints on the grate structure may limit the size of the pots that can be satisfactorily supported on such grates. In particular, some small pots could not span the distance between diametrically opposed fingers of such grates.

BRIEF DESCRIPTION OF THE INVENTION

Some aspects of the present invention therefore provide a supporting structure to cooperate with the integrally formed grate to provide a stable platform for supporting cooking utensils of varying sizes. This supporting structure, hereinafter referred to as the pot support, is formed of heat-conductive material able to withstand gas cooking temperatures without substantial alteration of its shape or composition. The pot support may be configured to rest in a stable position on or proximate to a gas burner head to support a small pot, pan, or other cooking utensil centered on a top of the pot support and to cooperate with fingers of the grate cooktop to support larger such utensils and utensils of various sizes when positioned off-center relative to the burner or grate.

In other aspects, the present invention provides a pot support for a cooktop with an integrally formed grate, in which the pot support includes a cap configured to fit on the gas burner head and a plurality of raised fingers on top of the cap extending radially outward from a center of the cap.

In still other aspects, the present invention provides a burner system having a burner head, a cooktop having an integrally formed grate around the burner head wherein the grate is configured to support a large utensil, and a pot support configured to rest on the burner head. The pot support is configured to support a small utensil when centered thereon or to cooperate with the grate to support a utensil that is positioned or located in an off-center manner over the burner.

It will thus be appreciated that configurations of the present invention provide stability and support for both large and small pots, pans and other cooking utensils, whether centered with respect to a gas burner or not. Also, in various configurations, the support is able to withstand temperatures introduced in the cooking process and avoid inhibiting combustion or cooking performance. These advantages accrue without requiring major modifications to the burner or cooktop surface that would compromise the performance of the unit.

DETAILED DESCRIPTION OF THE INVENTION

Figure 1:
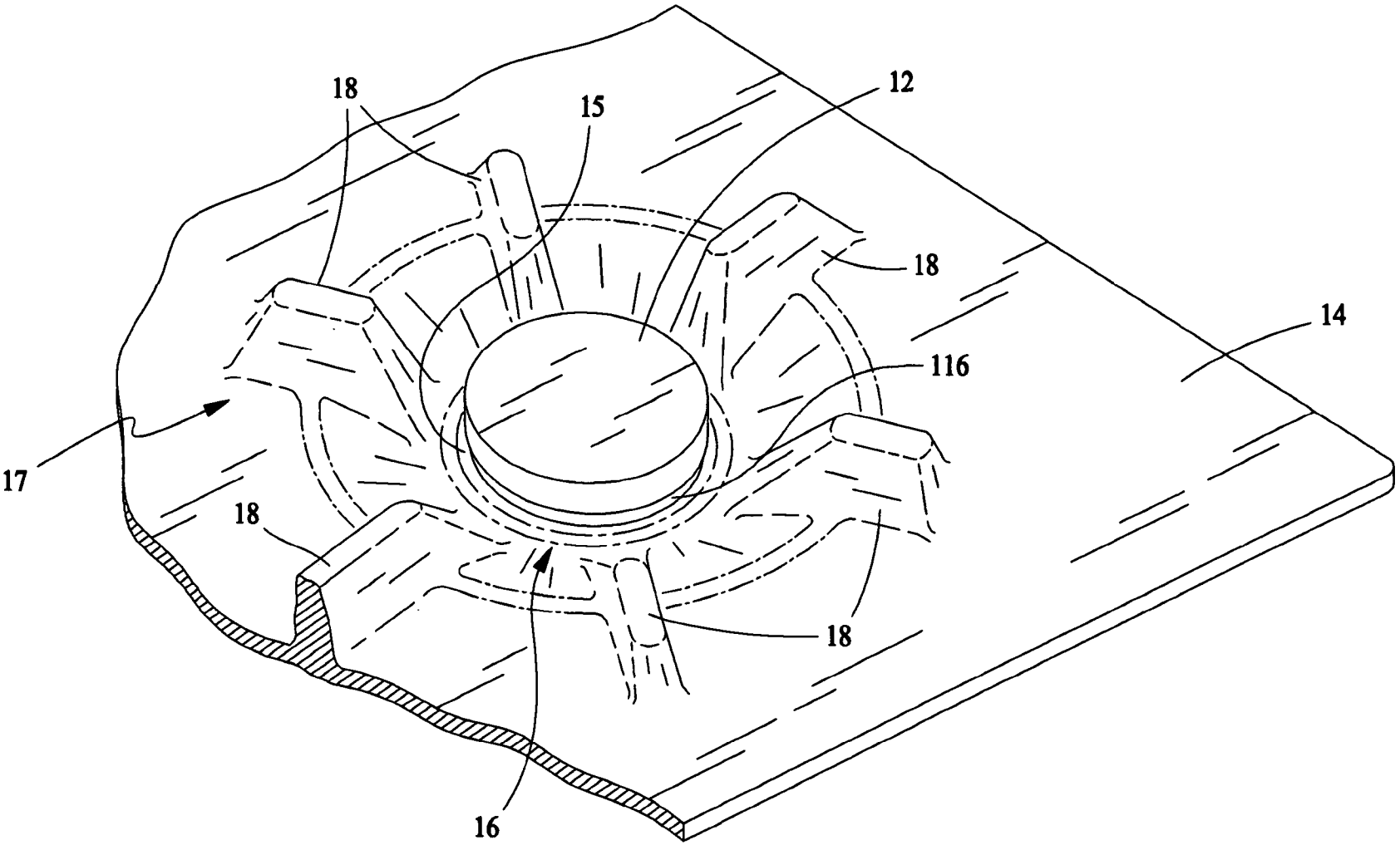
FIG. 1 is a partial perspective view representative of a first burner system configuration including a first pot support configuration of the present invention.

FIG. 1 shows a portion of a formed ceramic glass cooktop 14 for a gas surface cooking appliance. The portion of cooktop 14 proximate the opening 15 receiving the burner 16 has integrally formed therein a grate 17 for supporting cooking utensils over the burner 16. Hereinafter, the ceramic glass cooktop with the grate integrally formed therein will be referred to as a "ceramic grate cooktop." A pot support 12 is provided that rests on a gas burner 116 of burner 16. Support 12 alone or in cooperation with the fingers 18 of grate 17 provides stability to a cooking utensil positioned above the burner 16 that might be too small to span the space between grate fingers on opposing sides of the burner as well as for pots of varying size that might be positioned off center relative to the burner and grate.

Pot support 12 may be formed of any suitable material or materials able to withstand the high temperatures found in gas cooking applications without substantial alteration of its shape or composition, including by way of example and not limitation, cast metal or ceramic glass, the latter being less desirable due to its poorer conductive properties and also configuration limitations. Pot support 12 can be of any shape that can rest on burner head 16 or cooktop surface 14 below in such a way to make pot support 12 sufficiently stable to support a small pot centered on top of it. For larger pots and for off-centered pots (not shown), the shape of pot support 12 is also such that fingers 18 of ceramic grate cooktop 14 cooperate with a surface of the pot support to support the pot. In addition, support 12 is preferably heat conductive to allow proper combustion and air flow such that burner 16 operation is not adversely affected. In general, sufficient airflow is provided around pot support 12 and/or between a cooking utensil and pot support 12 to avoid adversely affecting flame combustion or cause much impingement. In many configurations, a small distance is provided between burner ports (not visible in FIG. 1, but arranged around a periphery of gas burner head 116) and the bottom of support 12 to provide for proper operation. The distance provided depends upon the configuration of burner head 116 and burner ports (not shown) with which pot support 12 is to be used. In some configurations, pot support 12 is removable, while in others, it is affixed to burner head 116 or the cooking surface below (i.e., it is supported by a surface of cooktop 14 proximate burner 116).

Figure 4:
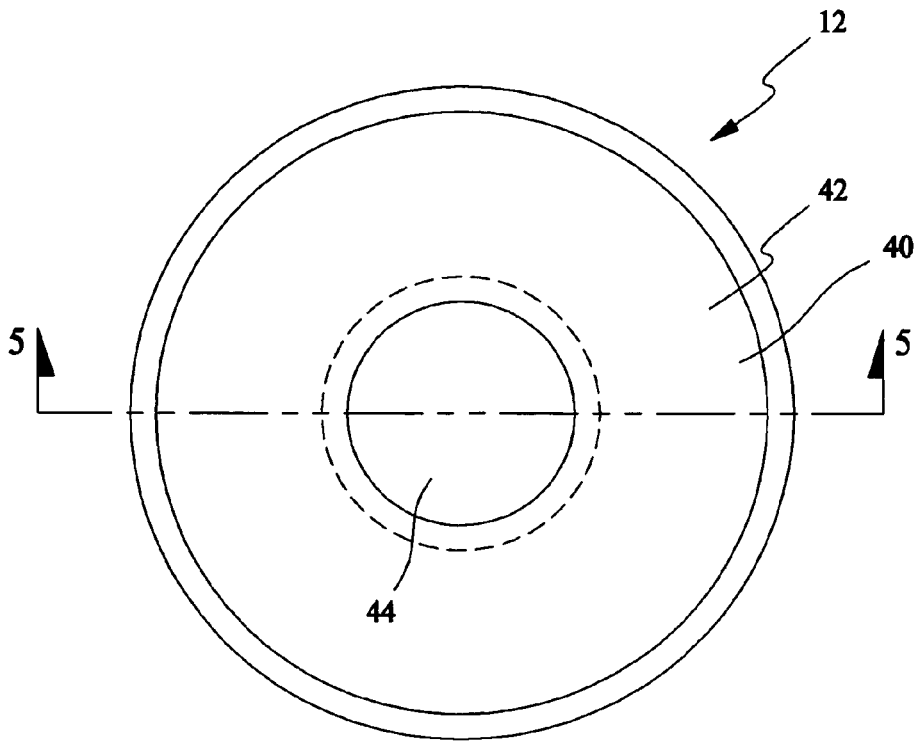
FIG. 4 is a bottom plan view of the first pot support configuration of FIG. 1.
Figure 5:
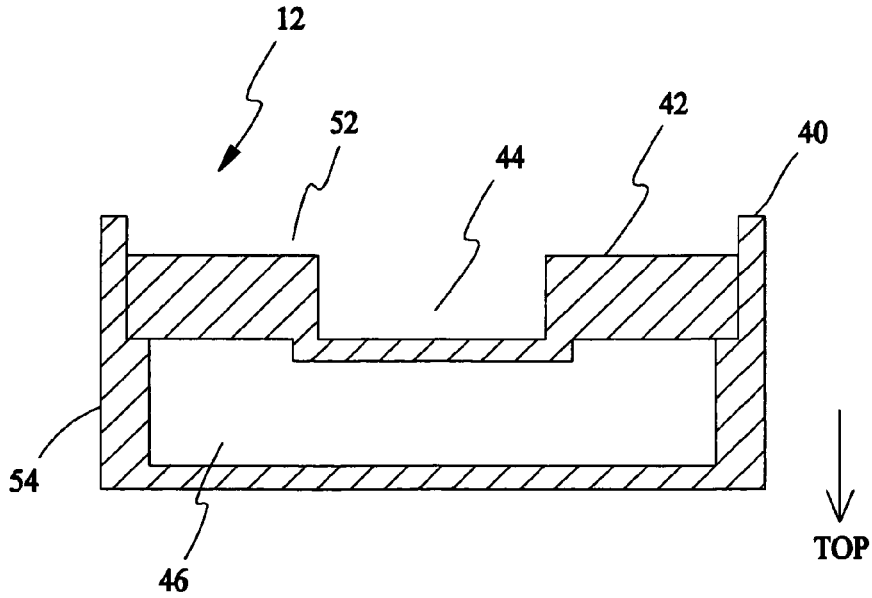
FIG. 5 is an inverted side cut-away view of the first pot support configuration of FIG. 4.

In some configurations and referring to FIG. 4 and FIG. 5, pot support 12 is configured as a cap to fit on gas burner head 116. For example, in some configurations, pot support 12 includes an extra rim 40 configured to snugly fit around the top rim of gas burner head 116, with surface 42 resting on the top of gas burner head 116. Some configurations of pot support 12 also include a stability chamber 44 and can include a hollow 46. Pot support 12 need not be unitary. In some configurations, for example, pot support 12 includes two or more separate pieces such as 52 and 54 that fit together to form pot support 12.

Figure 2:
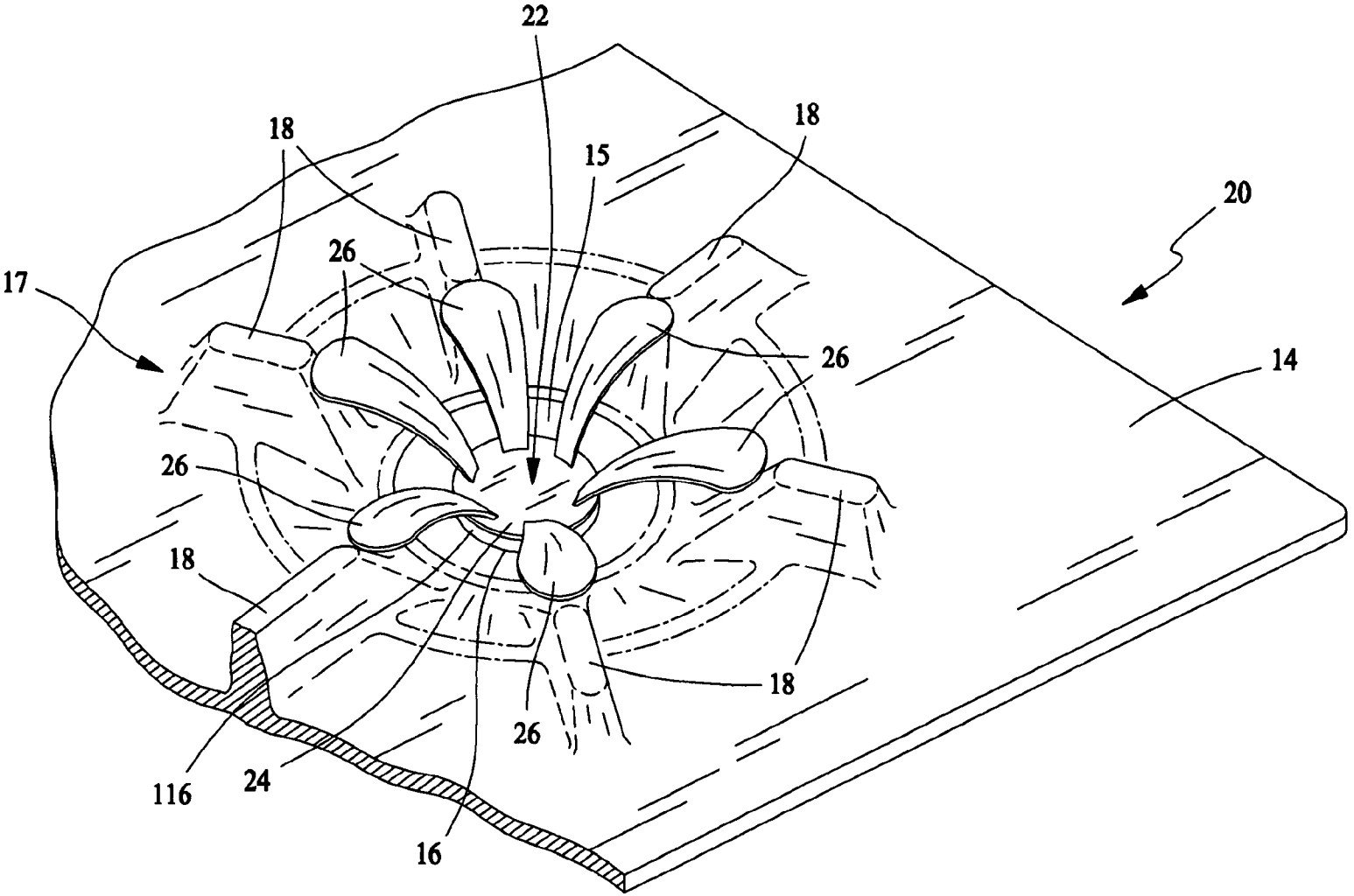
FIG. 2 is a partial perspective view representative of a second burner system configuration including a second pot support configuration of the present invention.

In another burner system configuration 20 and referring to FIG. 2, a pot support 22 is provided with petals 26 to provide enhanced support for a pot. Pot support 22 has a central portion 24 or cap configured to fit stably on a gas burner head 116. Pot support 22 also has a plurality of petals 26 extending upward and radially outward from a top of central portion 24. In some configurations, petals 26 are in register with fingers 18 to provide additional support under a pot, with only a small gap between each petal 26 and a corresponding finger 18. Pot support 22 may be formed of the same materials as pot support 12 and may also be removable from burner head 116. Pot support 22 can be configured as a cap that fits on gas burner head 116.

Figure 3:
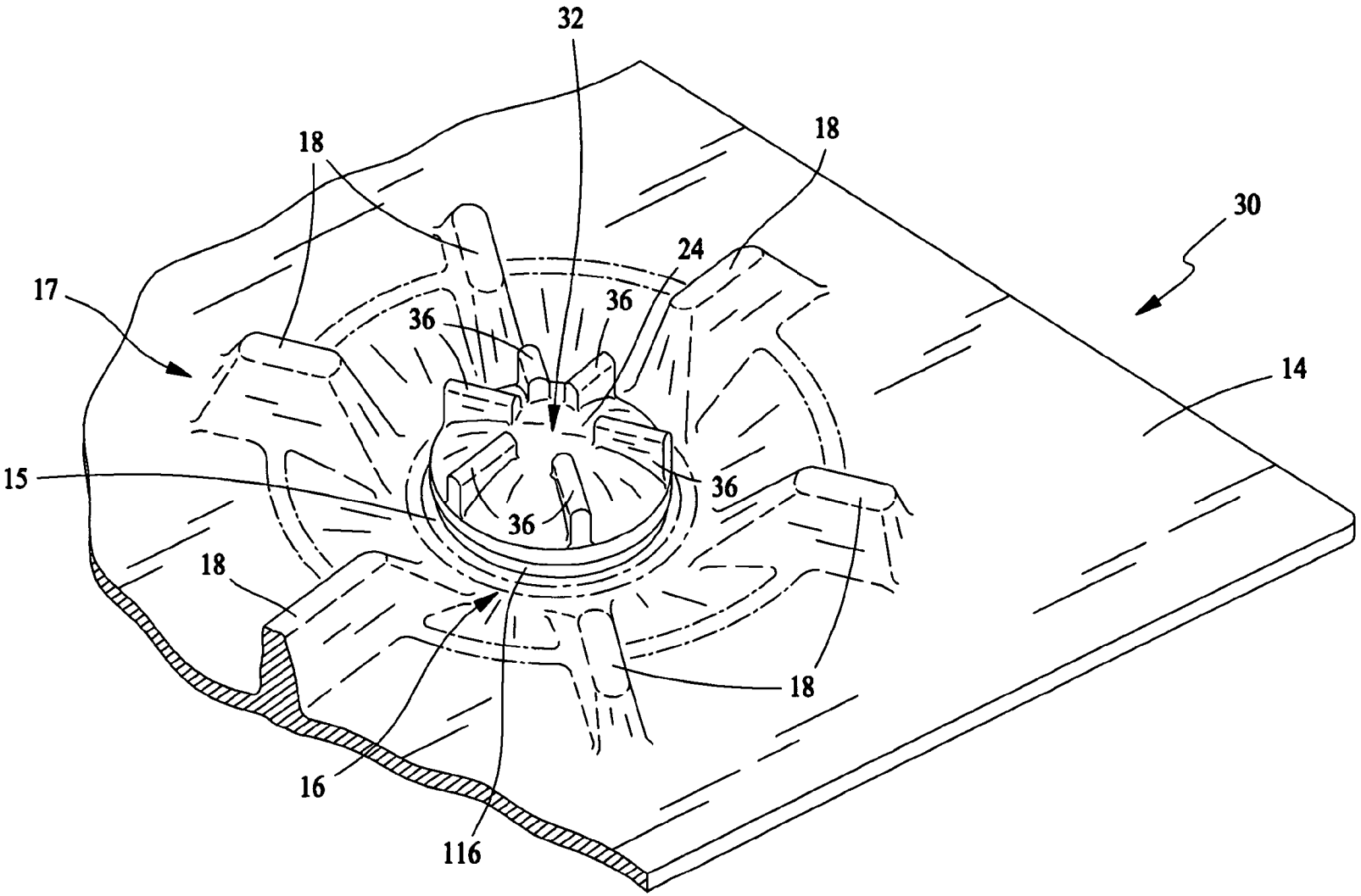
FIG. 3 is a partial perspective view representative of a third burner system configuration including a third pot support configuration of the present invention.

In still another burner configuration 30 and referring to FIG. 3, a pot support 32 is configured as a cap that fits on gas burner head 116. Pot support 32 is provided with raised fingers 36 on a top of central portion or cap 24 that extend radially outward from a center thereof. In some configurations, raised fingers 36 line up with fingers 18 to provide additional support under a pot, with only a small gap between each raised finger 36 and a corresponding finger 18 on cooktop surface 14. Pot support 32 may be formed of the same materials as pot support 12 and may also be removable from burner head 116. Pot support 32 can be configured as a cap that fits on gas burner head 116.

Figure 6:
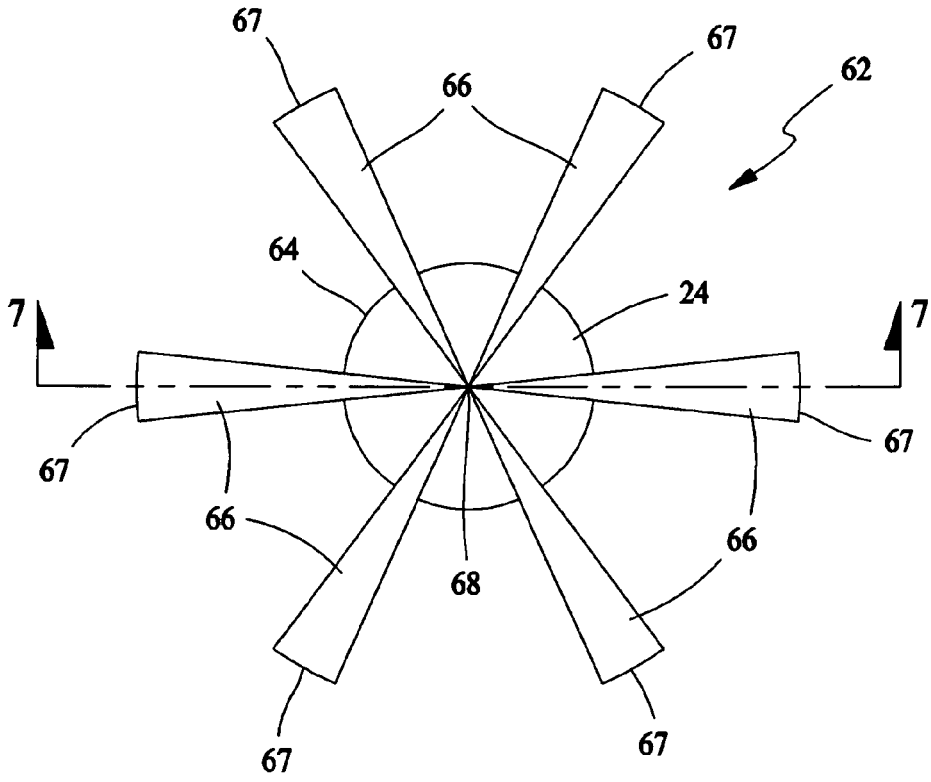
FIG. 6 is a top plan view of a fourth pot support configuration of the present invention.
Figure 7:
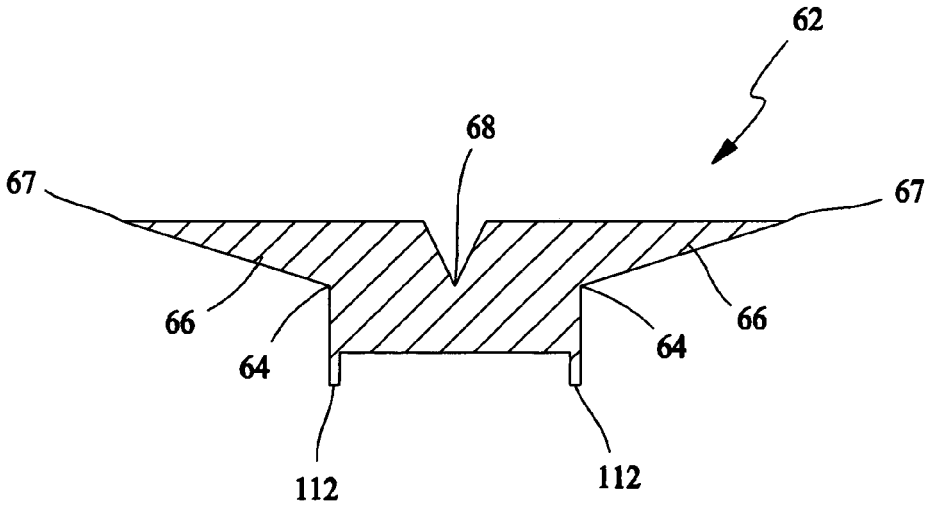
FIG. 7 is a side cut-away view of the pot support configuration of FIG. 6 along a cut indicated by line 7-7 in FIG. 6.

In yet another configuration of pot support 62 and referring to FIG. 6 and FIG. 7, pot support 62 includes a plurality of raised fingers 66 that extend outwardly beyond a rim 64 of a central cap portion 24 of pot support 62. Fingers 66 in some configurations are radially tapered from their outermost extent 67 towards the center of central cap portion 24. Also in some configurations, fingers 66 are vertically tapered from a rim 64 of central cap portion 24 to an outermost extent 67 of fingers 66.

Figure 8:
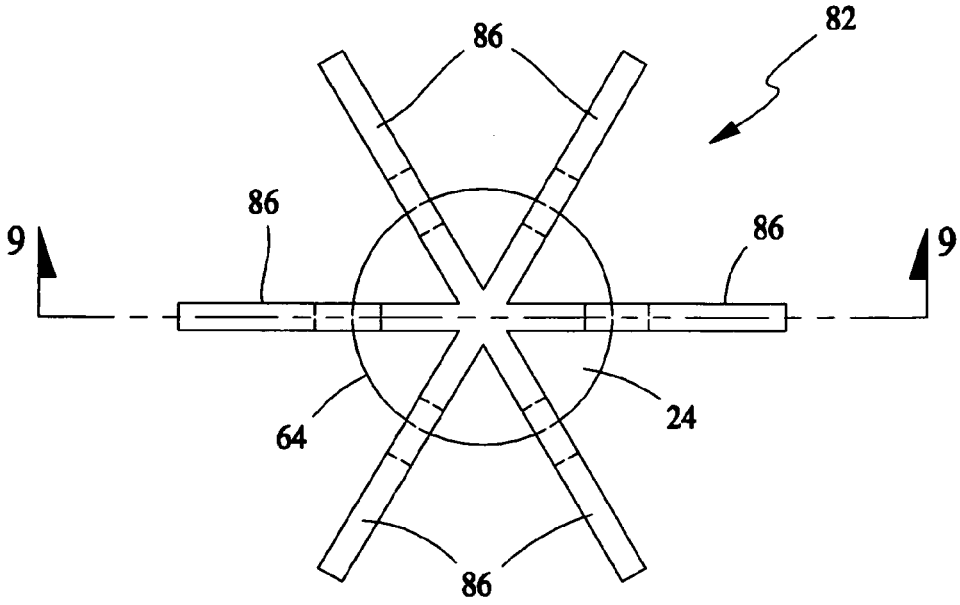
FIG. 8 is a top plan view of a fifth pot support configuration of the present invention.
Figure 9:
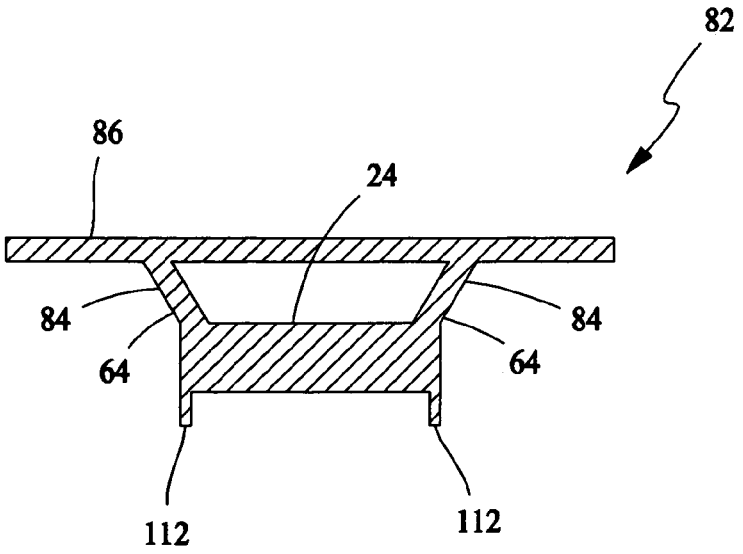
FIG. 9 is a side cut-away view of the pot support configuration of FIG. 8 along a cut indicated by line 9-9 in FIG. 8.
Figure 10:
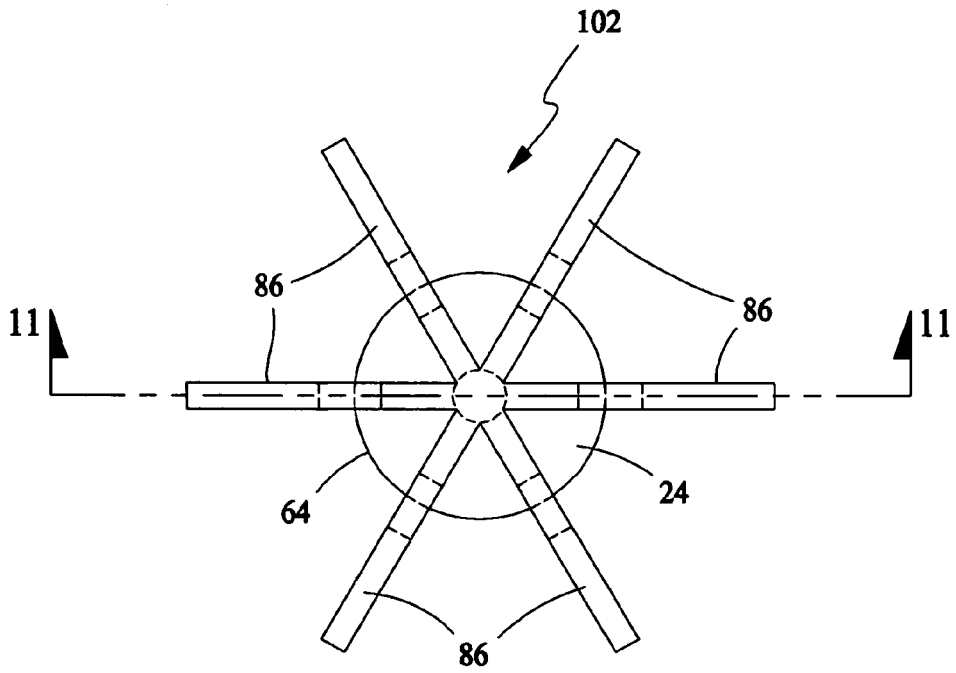
FIG. 10 is a top plan view of a sixth pot support configuration of the present invention.

In yet another configuration of pot support 82 and referring to FIG. 8 and FIG. 9, fingers 86 are raised and supported on struts 84 above a top surface of a central cap portion 24. Some of these configurations include raised fingers 86 that extend outwardly beyond a rim 64 of central cap portion 24. In some configurations of pot support 102 and referring to FIG. 10 and FIG. 11, a center post 104 on central cap portion 24 is also provided to support fingers 86.

Figure 11:
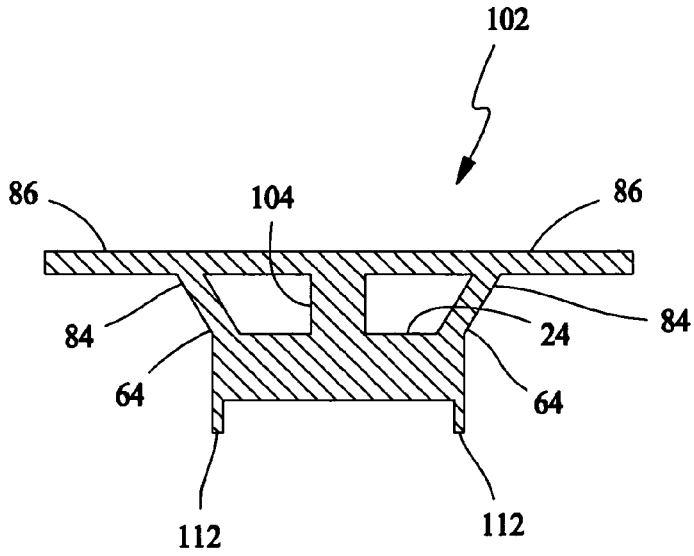
FIG. 11 is a side cut-away view of the pot support configuration of FIG. 10 along a cut indicated by line 11-11 in FIG. 10.

In some configurations and referring to FIGS. 7, 9, and 11, pot support 62, 82, and/or 102, can include a rim 112 configured to fit securely around a top rim of a gas burner.

While the invention has been described in terms of various specific embodiments, those skilled in the art will recognize that the invention can be practiced with modification within the spirit and scope of the claims.

What is claimed is:

1. A grate and pot support for a gas cooktop of the type having one or more gas burners positioned in at least one burner cavity formed in a surface of the cooktop, said grate and pot support comprising:

a grate integrally formed in the cooktop proximate the one or more gas burners and comprising a plurality of grate fingers extending from within the at least one burner cavity to the surface of the cooktop;

a pot support formed integrally with said plurality of grate fingers, said pot support configured to be supported in a stable position over the one or more gas burners to support a cooking utensil centrally positioned over the one or more gas burners and to cooperate with said grate to support utensils positioned off-center over the one or more gas burners; and a cap configured to receive a burner head of each of the one or more gas burners, said cap comprising a rim extending to fit around a top rim of the burner head and comprising a plurality of raised fingers extending radially outward from a top surface of the cap, each raised finger of said plurality of raised fingers continuously radially tapered from a first end to a second end coupled to said top surface.

2. A grate and pot support in accordance with claim 1 wherein said cap includes a stability chamber.

3. A grate and pot support in accordance with claim 2 wherein said cap is hollow.

4. A grate and pot support in accordance with claim 1 wherein said cap is removable.

5. A grate and pot support in accordance with claim 1 wherein said cap comprises a central portion configured to fit stably on a burner and each said raised finger further comprises a petal extending upward and radially outward from a top of said central portion, said petal having a substantially uniform thickness between said first end and said second end.

6. A grate and pot support in accordance with claim 1 wherein said raised fingers extend outwardly beyond the rim of the cap.

7. A grate and pot support in accordance with claim 6 wherein said raised fingers are vertically tapered from the rim of the cap to an outermost extent of said fingers.

8. A grate and pot support in accordance with claim 1 wherein said raised fingers are on struts above a top surface of a central portion of said cap.

9. A grate and pot support in accordance with claim 8 wherein said raised fingers extend outwardly beyond the rim of the cap.

10. A grate and pot support in accordance with claim 1 further comprising a center post on said cap.

11. A burner system comprising:

a burner head;

a cooktop comprising:

a cooktop surface;

a burner cavity formed in said cooktop surface;

a grate around said burner cavity, said burner head positioned within said burner cavity, said grate comprising a plurality of grate fingers extending from within said burner cavity to said cooktop surface, said plurality of grate fingers each formed integrally with said burner cavity, wherein said grate is configured to support a relatively large diameter cooking utensil; and a pot support configured to rest on said burner head, said pot support configured to support a relatively small diameter cooking utensil when centered thereon or to support a relatively large or relatively small diameter utensil in cooperation with said grate when the utensil is off center relative to said grate, said pot support comprising a cap configured to receive said burner head, said cap comprising a rim extending to fit around a top rim of said burner head and comprising a plurality of raised fingers extending radially outward from a top surface of said pot support, each raised finger of said plurality of raised fingers continuously radially tapered from a first end to a second end coupled to said top surface.

12. A burner system in accordance with claim 11 wherein said pot support is removable.

13. A burner system in accordance with claim 11 wherein said cooktop is a formed glass cooktop.

14. A burner system in accordance with claim 11 wherein said plurality of grate fingers comprises diametrically opposed grate fingers on opposite sides of said burner head, and said cap is configured to support an off-center pot level with said diametrically opposed grate fingers when said cap is on said burner head.

15. A burner system in accordance with claim 14 wherein said cap includes a stability chamber.

16. A burner system in accordance with claim 11 wherein said bottom of said pot support includes a recessed portion configured to rest on the gas burner.

17. A burner system in accordance with claim 11 wherein each said raised finger further comprises a petal extending upward and radially outwardly from a top of a central portion of said pot support, said petal having a substantially uniform thickness between said first end and said second end.

18. A burner system in accordance with claim 11 wherein said raised fingers extend outwardly beyond the rim of the pot support.

19. A burner system in accordance with claim 18 wherein said raised fingers are vertically tapered from the rim of the pot support to said first end.

20. A burner system in accordance with claim 11 wherein said raised fingers are on struts.

21. A burner system in accordance with claim 11 further comprising a center post on said pot support.

* * * * *